United States Patent [19]

Bethke

[11] 3,974,748

[45] Aug. 17, 1976

[54] APPARATUS FOR COLLATING SHEET LIKE ELEMENTS

[75] Inventor: Erwin Bethke, Erkelenz-Keyenberg, Germany

[73] Assignee: F. L. Smithe Machine Company, Inc., Duncansville, Pa.

[22] Filed: Aug. 2, 1974

[21] Appl. No.: 494,191

Related U.S. Application Data

[62] Division of Ser. No. 328,135, Jan. 30, 1973, Pat. No. 3,847,384.

[52] U.S. Cl. ..... 93/61 A; 93/62; 271/80

[51] Int. Cl.[2] ..... B31B 1/96

[58] Field of Search ..... 271/80, 179; 93/61 R, 93/62, 63 R, 63 M, 61 A

[56] References Cited

UNITED STATES PATENTS

| | | | |
|---|---|---|---|
| 2,031,136 | 2/1936 | Sewick | 271/80 |
| 2,287,719 | 6/1942 | Beasley | 93/62 X |
| 3,377,929 | 4/1968 | Ware et al. | 271/179 X |
| 3,537,362 | 11/1970 | Harper | 93/62 |
| 3,630,125 | 12/1971 | Helm | 93/62 |
| 3,643,555 | 2/1972 | Ehlscheid | 93/62 |

*Primary Examiner*—James F. Coan
*Attorney, Agent, or Firm*—Stanley J. Price, Jr.

[57] ABSTRACT

Apparatus for collating sheet like elements that includes initially feeding the sheet elements by a first conveyor in a spaced tandom relation at a high linear velocity into a spiral carrier. The spiral carrier includes a plurality of arcuate fingers having spiral slots formed therebetween. The sheets traveling at the relatively high rate of speed are projected individually into the slots of the spiral carrier also traveling at a relatively high linear speed. As each of the sheets follows the inwardly spiraling path of the slots, their linear velocity is substantially reduced so that when the sheet edges contact a stop plate, they are decelerated from the initial high linear speed. The stop plate directs the sheets radially outwardly from the slots of the spiral carrier into frictional engagement between the endless belts of a second conveyor. The second conveyor traveling at a substantially lower linear speed feeds the sheets in a continuous stream exposing only a marginal edge between adjacent elements for completion of further production operations. The sheet like elements are then supplied by the second conveyor in underlapped relation to a separator conveyor and are discharged therefrom onto a transfer conveyor.

9 Claims, 4 Drawing Figures

APPARATUS FOR COLLATING SHEET LIKE ELEMENTS

This is a division of application Ser. No. 328,135, filed Jan. 30, 1973, now U.S. Pat. No. 3,847,384.

BACKGROUND OF THE INVENTION

1. Field of the Invention

This invention relates to an apparatus for collating sheet like elements and more particularly to an apparatus for collating envelope blanks in underlapped relation for application of sealing adhesive to the marginal edges of the seal flap left exposed between adjacent envelopes.

2. Description of the Prior Art

The application of gumming adhesive to a marginal area of the seal flap of an envelope by conveying individual envelope blanks from a fast moving mechanism to a slow moving mechanism for arranging the blanks in a staggered or lapped relation to permit continuous application of a gumming adhesive by a roller applicator to the marginal edges of the blanks is known, as illustrated in U.S. Pat. Nos. 3,141,667; 3,096,977; 2,918,278; 3,479,025 and 3,672,667. U.S. Pat. No. 2,782,898 provides a mechanism for collating envelope blanks by transferring the blanks from a fast conveying means onto a slow conveying means positioned at a lower lever to thereby prevent interference between the slow advancing trailing edge of a blank with the faster advancing leading edge of the next following blank. A resilient paddle wheel disposed between the conveying means engages the blanks as they leave the bight of the faster conveyor providing continuous travel of the blanks at the fast linear speed to the lower plane where the blanks are engaged by the slow conveyor.

The paddle wheel maintains the traveling blank at the fast linear speed until the forward edge of the blank engages the rollers of the slow conveyor. The trailing edge of the slow moving blank then falls clear of the fast moving leading edge of the succeeding blank which then is thrust into the feed bight of the slow conveyor. With this arrangement the succeeding blank overlap moves at a higher relative speed into overlapped relation with the preceding blank subsequently engaged in the feed bight of the slow conveyor. In the collating of formed envelopes having window patches secured thereto, relative movement between successive envelopes in lapped relation frequently results in the hooking of window patches by the following edge of the preceding envelope to skew the entire stream of envelopes.

U.S. Pat. No. 1,681,162 discloses a delivery apparatus for printing presses arranged to separate newspapers into unit piles coming from a press. The printed papers are initially folded and collected for delivery between a pair of overlying fold-laying rollers which direct successively moving folded papers downwardly along the face of a plurality of guide bars. The papers advancing downwardly along the faces of the guide bars are discharged into slots between adjacent arms of a plurality of rotary fly devices. The rotary fly devices rotate in a clockwise direction and deliver successive papers one at a time upon the delivery belts providing for relative movement of adjacent papers as they are transformed from a continuous spaced stream to a stacked relation on the belts.

A kicker device traveling on the surface of a cam which revolves in timed relation to the fly device and fold-laying rollers are arranged to contact the advance edge of the paper being carried downwardly and toward the left of the fly device. Contact with the paper edge moves the paper out of engagement with the fly device projecting the paper forwardly in advance of the position which the paper would otherwise have had upon the pile of papers on the belt. With this arrangement, the kicker device changes the position of one paper without changing the position of adjacent papers. Preferably, the kicker is actuated twice at each rotation of the cam to thereby change the position of one paper for every fifty papers received upon the belts to provide for separation of the papers in unit piles.

In U.S. Pat. No. 3,116,668, an envelope folding and delivery mechanism performs the operations of folding and adhering of the bottom flap of an envelope blank, folding of the dried seal flap, and delivery of the finished envelopes one by one into stack formation. The spaced out envelope blanks are transferred with the bottom flap leading and the seal flap trailing from a first suction drum to a second suction drum where the fold along the bottom flap is initiated as the blank advances over the drum. A continuously rotating pressure roller picks up the bottom flap of the blank released by the second suction drum and folds it over the body portion of the blank. Suction means on the second drum holds the leading margin of the seal flap portion to the drum while the body portion is folded over onto the seal flap portion. Thereafter, the folded blanks are discharged individually by the second drum at a relatively high initial rate of travel upwardly into the spiral slots of a comparatively slow revolving slotted carrier. The slotted carrier includes a plurality of overlapping curved slots which spiral inwardly in the direction of rotation of the carrier. The blanks are decelerated in the slots and are arrested by a stationary horizontal table which extends secant to the slotted carrier. The table acts to eject the blanks from the slots as the carrier continues to rotate downwardly. In this manner, all the blanks are stacked so that the lower edges are pressed against the table with the blanks arranged in a fully overlapped relation. As each envelope is added to the stack, the stack is pushed along the table by the carrier to the extent of the thickness of the added blank. The slotted carrier is not arranged to discharge the blanks from the surface of the table; consequently, the blanks come to a complete rest in a stacked relation.

U.S. Pat. No. 1,266,737 described an apparatus for directing a plurality of folded sheets in a first direction and then a plurality of folded sheets in another direction. The two bundles of sheets are then arranged into one pile in which the folded edges face in opposite directions. Initially, folded sheets are delivered by a pair of cylinders between two guides in a continuous stream. A pair of fans are positioned adjacent each other with their fan blades arranged tangent to the opening between the guides. The fans are supported for oscillating motion on shafts which are positioned in the side frame at different levels so that the blades of one fan may be arranged to receive folded sheets discharged from between the guides while the blades of the other fan are withdrawn from the path of the sheets. With this arrangement, the blades of one fan receive the folded sheets and deliver them to a conveyor in stacked relation, the succeeding sheet positioned upon the preceding sheet. Then after a predetermined number of sheets have been stacked, the first fan is withdrawn from the guide path and the other fan is oscillated into position to receive the sheets. The second fan revolving in the reverse direction of the first fan, delivers the sheets in reverse position upon the stack of sheets positioned beneath the blades of the first fan. When the desired number of sheets have been stacked, an elevator removes the bundle for further processing.

There is need for an envelope collating mechanism that does not require elaborate apparatus to efficiently reduce the speed of the individually conveyed envelope blanks for orderly arrangement in lapped relation for further processing. Further, there is need for a collating apparatus which arranges successive blanks in a lapped relation without necessitating relative movement between blanks as they are positioned in lapped relation.

SUMMARY OF THE INVENTION

The hereinafter described invention relates to apparatus for collating a plurality of sheet like elements that are initially conveyed in spaced tandem relation at a first preselected linear speed. A first conveying means transfers the separated sheet elements at a high linear speed into a collating mechanism. The collating mechanism includes a pair of spaced spiral carriers each having a plurality of slots arranged to receive the sheet elements as they are discharged from the fast moving conveyor. The spiral carrier receives the sheet elements in the receiving slots and the sheets are then directed inwardly along the spiral path of the slots. The bottom edges of the sheets contact a stop plate interposed between the spaced spiral carriers. The stop plates arrest the circular motion of the sheets and direct the sheets radially outwardly in the slots. The sheets positioned in the slots are decelerated and are discharged from the slots in underlapped relation as they are positioned on a second conveying means.

The linear speed of the second conveying means is sufficiently lower than the linear speed of the first conveying means so that the sheet elements are arranged in underlapped relation to expose a marginal edge between adjacent sheets. As the underlapped sheets are fed between the endless belts of the second slower conveying means sealing adhesive is continuously applied to the exposed edge by an adhesive applicator.

The sheets are conveyed through the endless belts of the second conveying means into frictional engagement with a separating conveying means in underlapped relation. Thereafter, the separating conveying means discharges the underlapped sheet elements to a transfer conveying means. The separating conveying means includes an endless belt that conveys the sheets around an enlarged drum arranged to travel at sufficiently greater linear speed that the second conveying means so that the sheets may be separated from their underlapped relation and positioned on the transfer conveying means for subsequent feeding to a drier section before the sheets are suitably stacked for further operations.

Accordingly, the principal object of this invention is to provide an apparatus for collating sheet elements in underlapeed relation by efficiently decelerating the separated sheets.

Another object of this invention is to provide an apparatus for collating sheet elements that maintains proper alignment of the sheets as they are being fed from a fast moving conveyor into a spiral carrier and thereafter to a slow moving conveyor.

Another object of this invention is to provide an apparatus for collating sheet elements that positions successive elements in underlapped relation without requiring relative movement of one element with respect to another element having a different linear speed.

Still another object of this invention is to provide an apparatus for collating formed envelopes having window patches secured thereto so that successive envelopes are lapped for application of gumming adhesive without having the following edge of a preceding envelope hooking the window patch of the succeeding envelope.

These and other objects of this invention will be more completely disclosed and described in the following specification, the accompanying drawings and the appended claims.

DESCRIPTION OF THE PREFERRED EMBODIMENTS

The term "collating apparatus" is intended to designate apparatus for rearranging blanks which are advanced at high speed in spaced relation into a slow moving band of blanks arranged in lapped relation.

Figure 1:
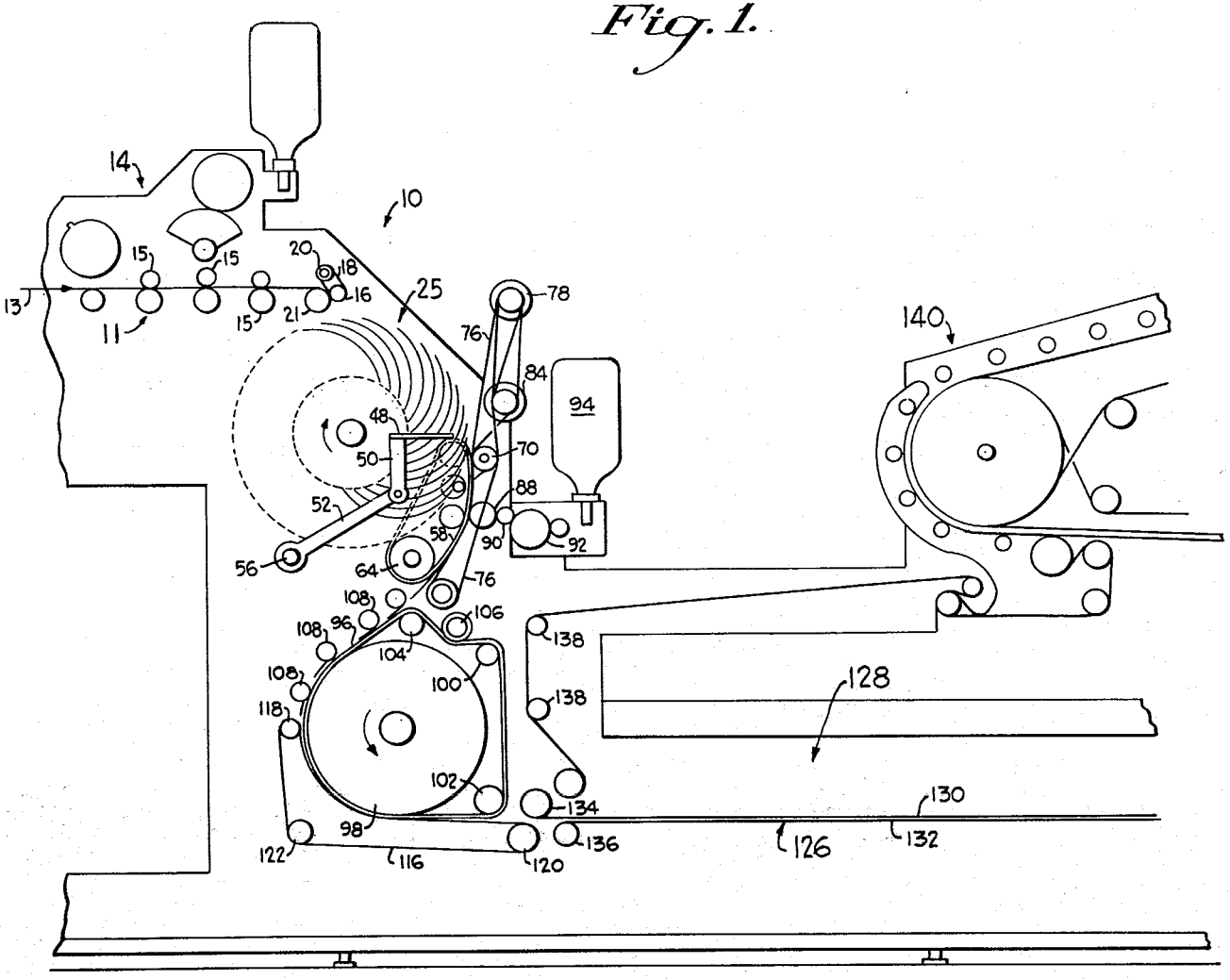
FIG. 1 is a schematic illustration in side elevation of the apparatus for collating sheet elements.

Referring to the drawings, and particularly FIG. 1, there is illustrated the apparatus for collating sheet like elements generally designated by the numeral 10 having a feed conveyor 11 from which the sheet like elements are initially supplied at a high preselected linear speed in spaced tandem relation for collating in an orderly arrangement and for additional production operations thereafter. For purposes of illustration only, the sheet like elements are hereinafter referred to as folded envelopes or envelopes 12; however, it should be understood that envelope blanks, folded or unfolded as shown om FIG. 2, or any other type of sheet like material also may be supplied by the feed conveyor 11 to the collating apparatus 10.

Figure 3:
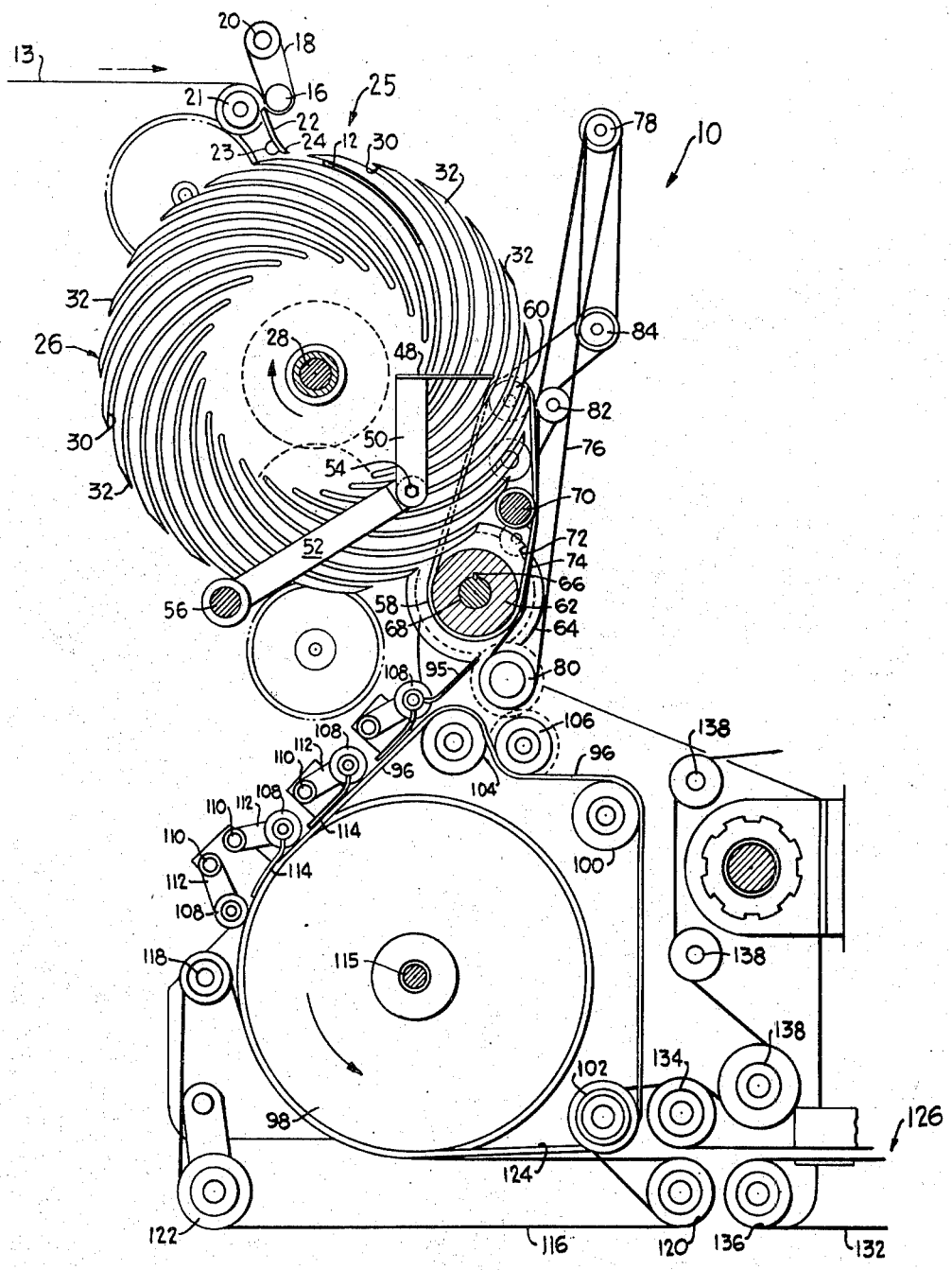
FIG. 3 is an enlarged schematic view in elevation of the collator section according to the invention.

In FIG. 1 of the illustrated embodiment of this invention a plurality of folded envelopes 12 are supplied in spaced tandem relation by the feed conveyor 11 after completion of preceding operations such as cutting, patching, folding, etc. in station 14. The feed conveyor 11 includes a plurality of suitable pressure rollers 15 arranged in abutting overlying relation and supported in the envelope machine side member (not shown). The pressure rollers 15 revolving at a preselected high peripheral velocity continually advance the envelopes 12 at a fixed high linear speed along the feedline 13 in the direction indicated by the arrow and into frictional engagement with a backing roll 16. The friction type backing roll 16 is supported by a pivot arm 18 that is, in turn, pivotally connected by pin 20 to the machine side member. The backing roll 16 abuts end pressure roller 21 and is driven at the same peripheral velocity thereof. A guide plate 22, as illustrated in FIG. 3, threadably secured to a support disc 23, which is suitably mounted in the machine side member, has an arcuate end portion 24. The guide plate 22 extends downwardly from a location adjacent the nip between the end pressure roller 21 and the backing roll 16.

Figure 4:
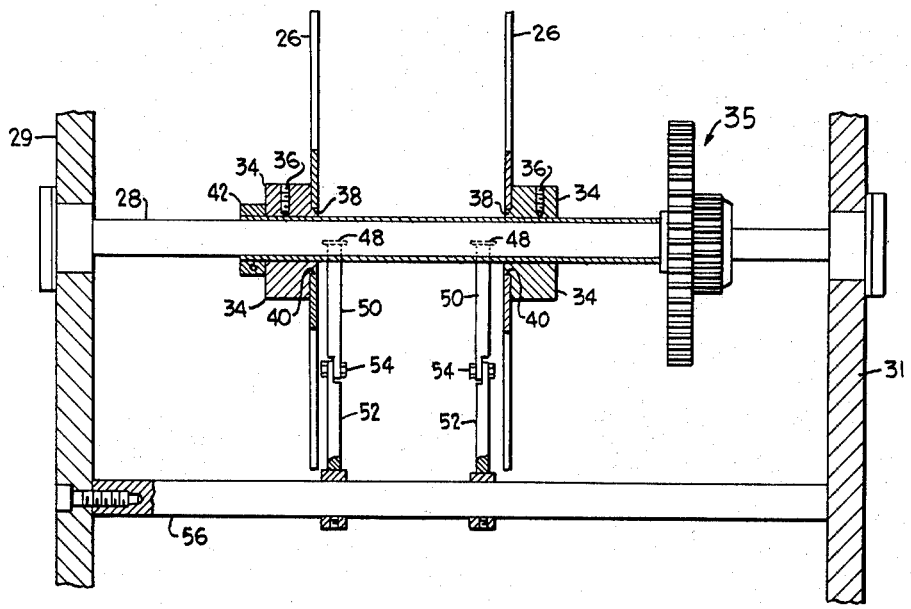
FIG. 4 is a fragmentary view in cross section illustrating the collator section according to the invention.

The fast moving envelopes 12 are directed downwardly through the nip between the end pressure roller 21 and the backing roll 16 and along the guide plate 22 into the collating mechanism generally designated by the numeral 25. The collating mechanism 25 includes a spiral carrier 26 having a plurality of spaced slotted discs or a single cylindrical member with a plurality of spaced slots therein mounted on the shaft 28 as illustrated in FIG. 4. The discs 26 have a plurality of pockets or slots 30 formed therein which are shaped as segments of a spiral. The particular configuration of the arcuate fingers 32 that form the slots 30 therebetween is such that there is a substantial opening in the slot adjacent the periphery of the discs 26. Each of the plurality of the slotted discs 26 is retained from relative movement on the shaft 28 journaled in the side frames 29 and 31 by a collar 34 nonrotatably mounted on shaft 28 by a set screw 36 threadably engaged to the shaft 28. The shoulder portion 38 of the collar 34 frictionally abuts the central bore 40 of the disc 26 for rotational movement therewith. The collar 34 is, in turn, retained from rotating on the shaft 28 by the hub 42 suitably clamped onto the shaft 28. Conventional drive gears 35 are carried on the shaft 28 for imparting rotation thereto at a preselected speed by a suitable power source.

Referring to FIG. 3, the configuration of the arcuate fingers 32 of the disc 26 is such that a substantial opening is provided in the slots 30 to receive the envelopes 12 traveling at the relatively high speed. The discs 26 are driven by the gearing 35 at a preselected peripheral velocity which may be greater than the velocity of the pressure rollers 15. The configuration of each of the plurality of spiral carriers 26 is such that there are provided substantially more slots than are necessary to receive the envelopes 12 supplied to the spiral carrier 26 from the feed conveyor 11. In the event an envelope misses one slot, the slot configuration is such that it will enter the next successive slot and the next finished envelope the follows may enter the next successive slot, or it may miss one or two successive slots before entering a slot so positioned to receive the envelope as it is propelled by the end pressure roller 21 and the backing roll 16 along the guide plate 22.

As the spiral carrier 26 rotates in the direction indicated by the arrow, the envelopes 12 contained in the slots 30 travel inwardly along the spiral path thereof and contact the stop plates 48 interposed between the spaced spiral carriers 26, as illustrated in FIG. 4. Preferably, the stop plate 48 is supported by a pivot arm 50 displaced transversely to the longitudinal axis of the shaft 28 so that the surface of the stop plate 48 is in juxtaposition to the carrier 26. The pivot arm 50 is connected to the end portion of lever 52 by pin 54. The lever 52 is nonrotatably mounted at its other end portion to a shaft 56 nonrotatably journaled in the machine side frames 29 and 31.

The envelopes 12 are projected into the slots 30 from the feed conveyor 11 with the envelope bottom edge 57 (shown in FIG. 2) foremost and decelerate as they follow the inwardly spiral path underlapping the preceding slot. The downward circular motion of the envelopes 12 positioned in the slots 30 is arrested by the stop plate 48. As the spiral carrier 26 continues to revolve clockwise, the envelopes 12 are directed along the horizontal surface of the stop plate 48 and radially outwardly in the slots 30. The envelopes 12 are discharged from the slots 30 at a continually decelerating rate of speed onto a pair of substantially slower moving conveyor belts 58, only one of which is shown. The conveyor belt 58 is arranged in a position adjacent the periphery of the spiral carrier 26 and along a vertical plane substantially at a right angle to a horizontal plate passing through the transverse axis of the shaft 28. However, it should be understood that conveyor belt 58 may be positioned at any other suitable location adjacent the periphery of the spiral carrier 26.

The conveyor belt 58 is reeved around end pulley 60 and the hub 62 of end pulley 64 with takeup pulley 70 positioned therebetween. The hub 62 is seated by a key 66 in a keyway of the shaft 68 for rotation therewith. Each of the conveyor belts 58 has a conveying reach 72 which is in abutting relation with overlying conveying reach 74 of each of the pair of endless belts 76, only one of which is shown. The endless belt 76 is reeved about end pulleys 78 and 80 and has takeup pulley 82. Suitable drive means (not shown) are provided to propel the conveyor belt 58 and the endless belt 76 at substantially the same preselected linear speed. A tension control pulley 84 is suitably arranged to maintain a preselected tension in the endless belt 76.

Figure 2:
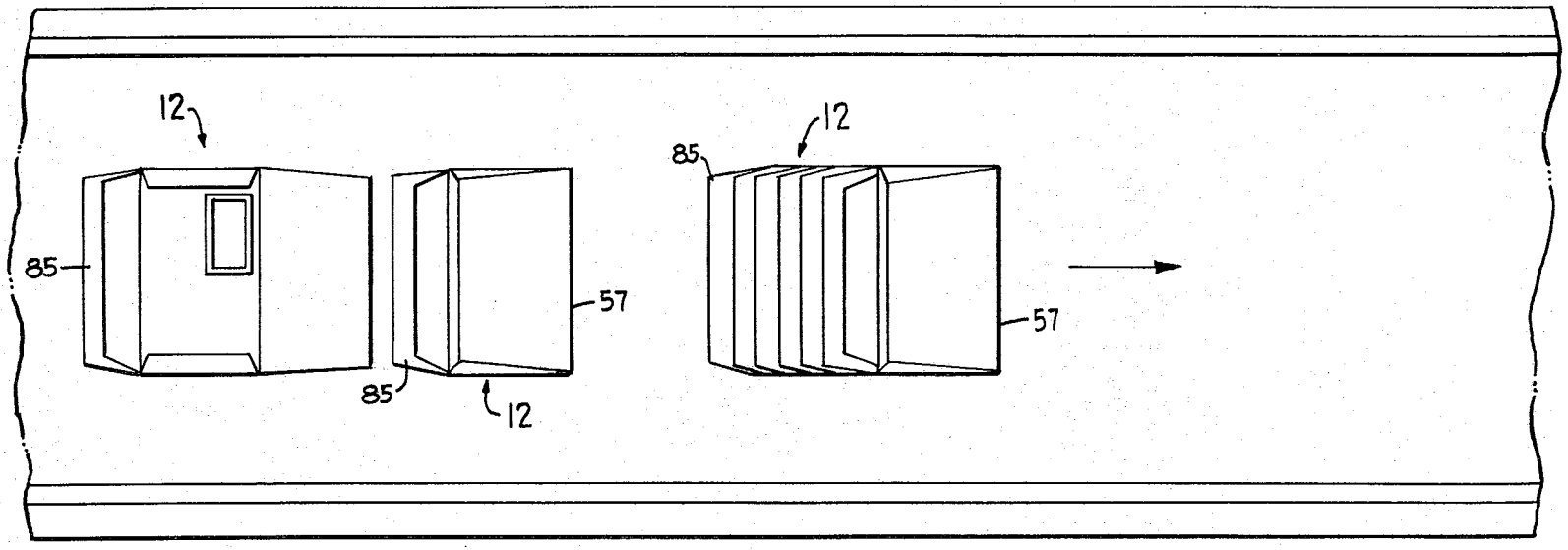
FIG. 2 is a diagrammatic view illustrating the sequential steps of forming an envelope and arranging the formed envelopes in underlapped relation for application of the sealing adhesive.

The spiral carrier 26 transfers without interruption the separated envelopes 12 from the fast moving conveyor 11 into frictional engagement between the slow moving conveyor belts 58 and 76. With this arrangement, the bottom edge 57 of a preceding envelope 12 is discharged from the slot 30 by the stop plate 48 and thrust into frictional engagement between the slow moving belts 58 and 76. The envelopes 12 discharged separately from the spiral carrier 26 are arranged in underlapped relation having a narrow margin exposed between adjacent seal flaps when received by the belts 58 and 76; therefore, no relative movement takes place between adjacent envelopes which would tend to skew the envelopes advancing in a continuous stream between the belts 58 and 76. The stream of envelopes pass in underlapped relation between the conveying reaches 72 and 74 into frictional engagement with an adhesive applicator roller 88 arranged between the pairs of belts 58 and 76. The roller 88 is provided to transfer a selected amount of adhesive onto the exposed margin of the closely adjacent envelope seal flaps. The periphery of the applicator roller 88 is continuously supplied with seal flap adhesive by a transfer roller 90 positioned in abutting relation with an adhesive roller 92. A continuous supply of the sealing adhesive is delivered from the reservoir 94 to the adhesive roller 92 and, in turn, to the applicator roller 88. The envelopes 12 are conveyed between the conveyor belts 58 and 76 in underlapped relation with the seal flap portions 85 of the envelopes aligned closely adjacent each other as illustrated in FIG. 2.

The band of envelopes are discharged from between the endless belts 58 and 76 into contact with a guide plate 95 and are thereafter introduced in the same underlapped relation onto endless belt 96 that conveys the envelopes 12 around the periphery of the enlarged drum 98. The endless belt 96 is reeved about the drum 98 and end pulleys 100 and 102 and maintained at a preselected tension by takeup pulleys 104 and 106. A series of carriage rolls 108 are pivotally secured to shafts 110 by levers 112 and are urged against the endless belt 96 around the periphery of the drum 98 by suitable resilient means. Guide bars 114 extend forwardly from the carriage roll shafts 110 and maintain the underlapped envelopes 12 in abutting relation with the endless belt 96 as the envelopes are conveyed around the circumference of the drum 98.

The drum 98 has a shaft 115 suitably mounted in the envelope machine frame and is driven at a preselected linear speed which is greater than the linear speed of the endless belts 58 and 76 so that the envelopes are separated, increasing the area of the marginal edges exposed between adjacent envelopes. The underlapped envelopes 12 are then fed into frictional engagement between the endless belts 96 and 116 after they have been conveyed around the circumference of the drum 98 by the cooperating guide bars 114 and the endless belt 96. The endless belt 116 is reeved about suitable end pulleys 118 and 120 and takeup pulley 122 in abutting relationship with an overlying conveying reach 124 of endless belt 96.

The envelopes 12 are discharged from between the endless belts 96 and 116 and are supplied therefrom to the transfer conveyor 126 located in the envelope machine drier section generally designated by the numeral 128, as illustrated in FIG. 1. The conveyor 126 is formed from endless tapes 130 and 132 that are reeved around suitable end pulleys 134 and 136 and have takeup devices 138. The endless tapes 130 and 132 of the conveyor 126 are preferably driven at a slightly higher speed than the endless belts 116 and 96 to thereby increase the speed between the bottom edges 57 of adjacent envelopes as they are engaged by the conveyor 126. The abrupt increase in linear speed separates the seal flap portion 85 of adjacent envelopes to prevent the envelopes 12 from adhering to each other after drying in section 128. Suitable drive means 140, schematically illustrated in FIG. 1, is provided to propel the endless tapes 130 and 132 for conveying the envelopes 12 through the drier section 128 and for discharging thereafter onto a suitable stacking device (not shown). It should be understood that other suitable drive means may be provided to propel the endless tapes 130 and 132, and the schematic belt drives illustrated in FIG. 1 are exemplary only.

According to the provisions of the patent statutes, I have explained the principle, preferred construction and mode of operation of my invention and have illustrated and described what I now consider to represent its best embodiments. However, I desire to have it understood that, within the scope of the appended claims, the invention may be practiced otherwise than as specifically illustrated and described.

I claim:

1. Apparatus for collating sheet like elements comprising, first conveyor means for conveying a plurality of sheet like elements in spaced tandem relation at a first preselected linear speed, second conveyor means for conveying said sheet like elements in underlapped relation as a continuous stream for further processing at a second preselected linear speed, said second conveyor means being positioned adjacent said first conveyor means, a collator mechanism positioned between said first conveyor means and said second conveyor means, said collator mechanism including a rotatable cylindrical member having spaced arcuate slots therein, said slots having a configuration of a segment of a spiral, stop means positioned adjacent to said cylindrical member, said collator mechanism arranged to receive said sheet like elements in spaced tandem relation from said first conveyor means, said sheet like elements arranged to move inwardly in said arcuate slots of said cylindrical member, said stop means arranged to stop the circular movement of said sheet like elements and the inward movement of said sheet like elements, said stop means arranged to move said sheet like elements radially outwardly in said spaced arcuate slots and align the edges of said sheet like elements on a surface of said stop means, said stop means arranged to discharge said sheet like elements from said slots in aligned lapped relation as a continuous stream at a reduced linear velocity to said second conveyor means, and an adhesive applicator roller positioned in abutting relation with said underlapped sheet like elements, said second conveyor means arranged to convey said underlapped sheet like elements into abutting relation with said adhesive applicator roller for continuously applying adhesive to the exposed marginal edges of said sheet like elements.

2. Apparatus for collating sheet like elements as set forth in claim 1 in which, said rotatable cylindrical member driven at a preselected peripheral velocity and positioned adjacent said first conveyor means to receive said sheet like elements discharged from said first conveyor means into said spaced arcuate slots of said cylindrical member, said spaced arcuate slots arranged to direct said moving sheet like elements inwardly along the circular path in the spirals of said spaced arcuate slots.

3. Apparatus for collating sheet like elements as set forth in claim 1 in which said collator mechanism includes, a plurality of spaced disc members having arcuate slots therein, said slots have a configuration of a segment of a spiral, said plurality of spaced disc members coaxially mounted on a shaft for rotational movement therewith at a preselected peripheral velocity, means for rotating said plurality of spaced disc members at a speed higher than said first preselected linear speed of said first conveyor means, and said stop means including a plurality of stop plates arranged between said plurality of spaced disc members.

4. Apparatus for collating sheet like elements as set forth in claim 3 in which, said arcuate slots in said disc members have an enlarged open end adjacent the periphery of said disc member for receiving said sheet like elements.

5. Apparatus for collating sheet like elements as set forth in claim 1 in which, said second conveyor means includes endless conveyor belts positioned in abutting, overlying relation, said endless conveyor belts positioned closely adjacent to the periphery of said collator mechanism.

6. Apparatus for collating sheet like elements as set forth in claim 5 in which, said endless conveyor belts of said second conveyor means driven at said second preselected linear speed less than said first preselected linear speed of said first conveyor means, said endless conveyor belts frictionally engage the sheet like elements discharged in underlapped relation from said spaced arcuate slots by said stop plate, said sheet like elements discharged from said spaced arcuate slots by said stop plate are frictionally engaged by said endless conveyor belts in a continuous stream arranged in underlapped relation and moving uniformly at said second preselected linear speed.

7. Apparatus for collating sheet like elements as set forth in claim 6 in which, said endless conveyor belts of said second conveyor means are positioned substantially perpendicular to the horizontal axis of rotation of said collator mechanism at a location closely adjacent the periphery thereof.

8. Apparatus for collating sheet like elements as set forth in claim 1 which includes, separator conveying means for separating said plurality of sheet like elements having preselected linear speed greater than the linear speed of said second conveyor means, and transfer conveying means for receiving said plurality of sheet like elements from said separator conveying means and transferring said elements, said transfer conveying means being positioned adjacent said separator conveying means.

9. Apparatus for collating sheet like elements as set forth in claim 1 wherein, said sheet like elements comprise formed envelopes having an ungummed open seal flap, said formed envelopes conveyed in spaced tandem relation by said first conveyor means and received individually in said spaced arcuate slots of said cylindrical member, said formed envelopes arranged in underlapped relation by said cylindrical member and having only the ungummed open seal flaps of adjacent envelopes exposed for subsequent application of seal flap adhesive on said second conveying means, said formed envelopes having window portions formed therein, said window portions formed therein, said window portions having a preselected length and covered with a translucent material secured to said formed envelopes.

* * * * *